US008162750B2

(12) United States Patent
Gagner et al.

(10) Patent No.: US 8,162,750 B2
(45) Date of Patent: Apr. 24, 2012

(54) GAMING DEVICE MULTILATERATION LOCATION

(75) Inventors: Mark B. Gagner, West Chicago, IL (US); Steven J. Lee, Naperville, IL (US)

(73) Assignee: WMS Gaming Inc., Waukegan, IL (US)

( * ) Notice: Subject to any disclaimer, the term of this patent is extended or adjusted under 35 U.S.C. 154(b) by 487 days.

(21) Appl. No.: 12/281,893

(22) PCT Filed: Mar. 6, 2007

(86) PCT No.: PCT/US2007/005815

§ 371 (c)(1),
(2), (4) Date: Jun. 10, 2009

(87) PCT Pub. No.: WO2007/103426

PCT Pub. Date: Sep. 13, 2007

(65) Prior Publication Data

US 2009/0305773 A1 Dec. 10, 2009

Related U.S. Application Data

(60) Provisional application No. 60/743,415, filed on Mar. 7, 2006, provisional application No. 60/746,785, filed on May 9, 2006.

(51) Int. Cl.
*A63F 9/24* (2006.01)

(52) U.S. Cl. ..... 463/29; 463/42

(58) Field of Classification Search ..... 463/29, 463/42

See application file for complete search history.

(56) References Cited

U.S. PATENT DOCUMENTS

| | | | | |
|---|---|---|---|---|
| 4,232,317 | A | 11/1980 | Freeny, Jr. | |
| 6,104,815 | A | 8/2000 | Alcorn et al. | |
| 6,508,710 | B1 | 1/2003 | Paravia et al. | |
| 6,665,715 | B1 | 12/2003 | Houri | |
| 6,843,725 | B2 | 1/2005 | Nelson | |
| 6,923,724 | B2 | 8/2005 | Williams | |
| 2002/0147049 | A1 | 10/2002 | Carter, Sr. | |
| 2003/0006931 | A1 | 1/2003 | Mages | |
| 2003/0139190 | A1 | 7/2003 | Steelberg et al. | |
| 2003/0224855 | A1 | 12/2003 | Cunningham | |
| 2004/0087370 | A1 | 5/2004 | Tarantino | |
| 2004/0162124 | A1 | 8/2004 | Barton | |
| 2005/0193209 | A1 | 9/2005 | Saunders et al. | |
| 2005/0197190 | A1 | 9/2005 | Amaitis et al. | |
| 2008/0182644 | A1 * | 7/2008 | Lutnick et al. | 463/20 |
| 2008/0300055 | A1 * | 12/2008 | Lutnick et al. | 463/39 |
| 2009/0111562 | A1 * | 4/2009 | Chudd et al. | 463/20 |
| 2010/0093429 | A1 * | 4/2010 | Mattice et al. | 463/25 |

OTHER PUBLICATIONS

"International Application Serial No. PCT/US2007/005815, International Preliminary Examination Report mailed Feb. 9, 2009", 17 pgs.
Aatique, M. , "Evaluation of TDOA Techniques for Position Location in CDMA Systems", *Master of Science Thesis, Virginia Polytechnic Institute and State University*, (Sep. 1997),1-125.
"International Application U.S. Appl. No. PCT/US2007/05815, Search Report mailed Oct. 19, 2007", 5 pgs.
"International Application Serial No. PCT/US2007/05815, Written Opinion mailed Oct. 19, 2007", 7 pgs.

* cited by examiner

*Primary Examiner* — Pierre E Elisca
(74) *Attorney, Agent, or Firm* — Schwegman, Lundberg & Woessner, P.A.

(57) ABSTRACT

Apparatus, systems, and methods may operate to enable determining the location of a wagering game machine in relation to a plurality of transmission or reception apparatus using a multilateration process. In some embodiments, the orientation of the machine may also be determined.

23 Claims, 5 Drawing Sheets

GAMING DEVICE MULTILATERATION LOCATION

RELATED APPLICATIONS

This patent application is a U.S. National Stage Filing under 35 U.S.C. 371 from International Patent Application Serial No. PCT/US2007/005815, filed Mar. 6, 2007, and published on Sep. 13, 2007 as WO 2007/103426 A2 and republished as WO 2007/103426 A3, which claims the priority benefit of U.S. Provisional Patent Application Ser. No. 60/743,415 filed Mar. 7, 2006 and entitled "MULTILATERATION POSITIONING SYSTEM FOR LOCATING A GAMING DEVICE", and of U.S. Provisional Patent Application Ser. No. 60/746,785 filed May 9, 2006 and entitled "GAMING DEVICE MULTILATERATION LOCATION", the contents of which are incorporated herein by reference in their entirety.

COPYRIGHT

A portion of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007, WMS Gaming, Inc.

FIELD

Embodiments of the inventive subject matter relate generally to wagering game machines, and more particularly, to locating wagering game machines in two-dimensional and three-dimensional space.

BACKGROUND

Wagering game makers, and wagering game machine manufacturers, strive to provide a gaming experience that is interesting and attractive to game players. In some cases, the gaming experience may be enhanced by locating the physical location of a gaming machine in space. Obtaining the location of wagering game machines, especially mobile wagering game machines, may also be useful with respect to security considerations.

DETAILED DESCRIPTION

Example Operating Environment

Figure 1:
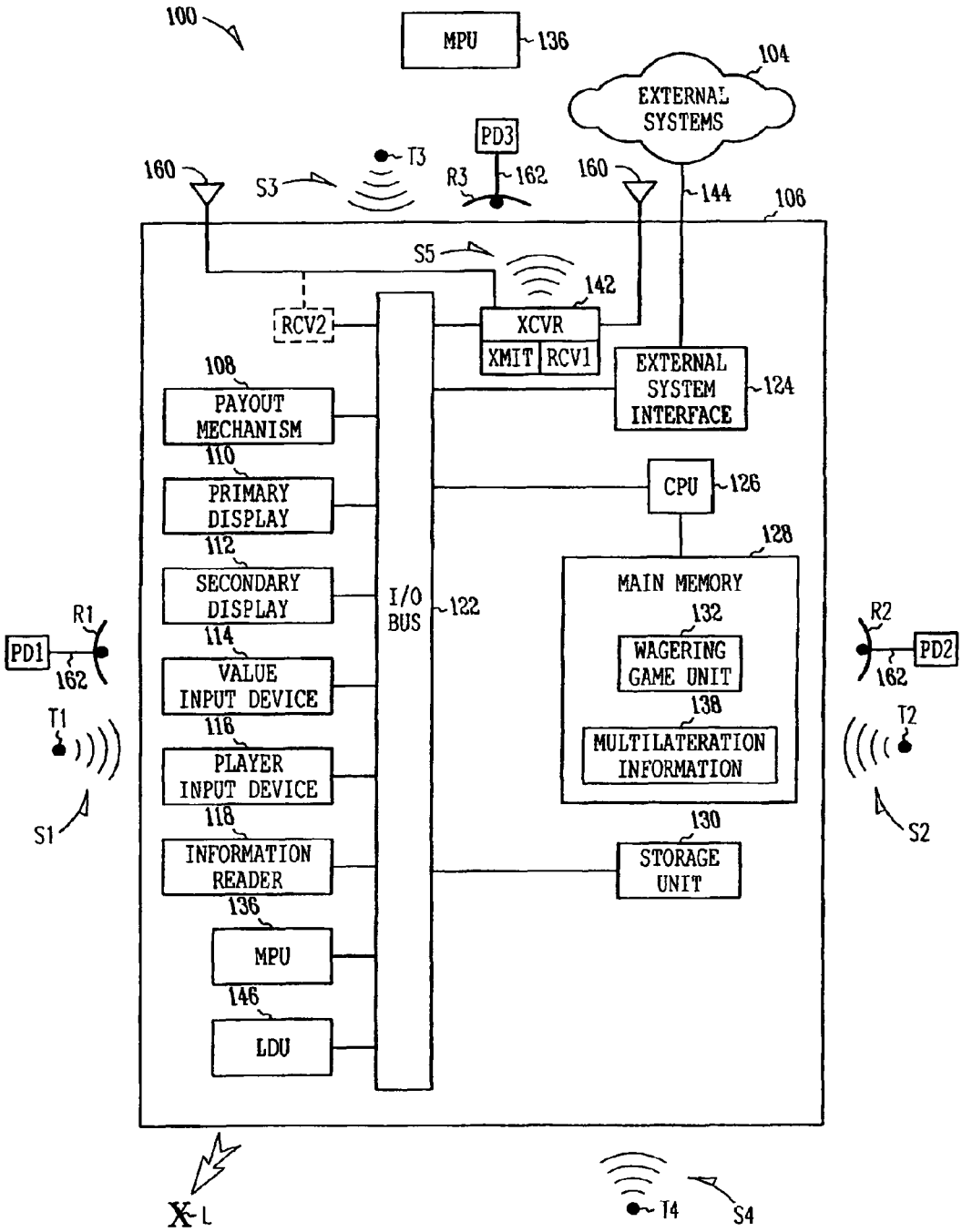
FIG. 1 is a block diagram of a wagering apparatus and a wagering game machine, according to example embodiments of the invention.

In order to locate a wagering game machine, especially a mobile wagering game machine, multilateration information may be used. For the purposes of this document, "multilateration information" means either phase difference, or time difference of arrival information that may be obtained by a receiver after receiving signals from at least two transmitters, wherein the signals are sent in a substantially simultaneous fashion. Alternatively, the signals may be sent at different times, but may have information encoded therein to indicate the time of transmission so that phase/time difference information may be derived therefrom.

For example, if a receiver is able to receive a first signal from a first transmitter, and a second signal from a second transmitter, the multilateration information obtained therefrom would be available from either phase difference information or time difference of arrival information, such that the receiver could determine that the signals arrived 95 degrees out of phase at some given frequency, or 3 microseconds apart, for example.

Thus, in some embodiments, the phrase "multilateration positioning system" may include a system that produces hyperbolic lines of position (LOP) through the measurement of the difference in times of reception (or phase difference) between radio signals arriving from two or more synchronized transmitters operating at fixed points, or a transmitter providing a signal to two or more receivers operating a fixed points.

In some examples, the signals are broadcasted simultaneously or virtually simultaneously. In other examples, a known fixed delay is used and the receiver subtracts the delay when making its positioning calculations. The use of one or more delays can prevent unauthorized receivers from using the transmitted signals. In addition, many types of wireless mechanisms can be used, such as sound, infra-red (IR), ultraviolet (UV), and visible light.

During the multilateration process, a receiver, or related measuring apparatus, may be used to measure the time difference (or phase difference) between arriving signals. The difference in the times of arrival (or phase) are substantially constant along a hyperbola having the two transmitting stations as foci. The arriving signals are located somewhere along a hyperbolic LOP corresponding to the determined time or phase difference. Using a $3^{rd}$ transmitting station (or a $2^{nd}$ pair of transmitting stations), the measuring apparatus can measure a second time or phase difference and obtain another hyperbolic LOP. The intersection of the LOPs between the two hyperbolae provides a fix on the receiver position in a plane. Similarly, the intersection of three hyperbolae provides a fix on the receiver position in three-dimensional space.

Using multilateration methodology in a gaming facility, such as a casino, to provide the location of wagering game machines may be advantageous for a number of reasons. For example, in some jurisdictions, gaming regulations require that wagering games only be played in certain authorized areas. Locating wagering game machines using multilateration permits a game provider to programmatically disable a wagering game machine when it exits an authorized area and re-enable the wagering game machine when it re-enters the authorized area. In another example, the use of location data can adaptively enable or disable certain game features or even entire games based on the location of the wagering game machine. For example, a wagering game used to play keno may only provide a user the keno user interface when the wagering game's location is in close proximity to the keno board in a casino. In another example, the use of location data permits the owners of wagering game machines to track their assets (e.g., mobile wagering game units) in and around the premises to provide for increased security, including protection against theft.

FIG. 1 is a block diagram illustrating a wagering apparatus 100 and a wagering game machine 106, according to example embodiments of the invention. As shown in FIG. 1, the wagering game machine 106 may include a central processing unit (CPU) 126 coupled to a main memory 128, which may include a wagering game unit 132 and multilateration information 138.

In some embodiments, the wagering game unit 132 can receive wagers and conduct wagering games, such as video poker, video black jack, video slots, video lottery, etc. In some embodiments, the apparatus 100 may include a multilateration positioning unit (MPU) 136 that can derive the multilateration information 138 from received signals, as described herein. The multilateration information 138 may be stored in the memory 128, or in the storage unit 130.

The CPU 126 may be connected to an input/output (I/O) bus 122, which facilitates communication between the wagering game machine's components. The I/O bus 122 may be connected to a payout mechanism 108, a primary display 110, a secondary display 112, a value input device 114, a player input device 116, an information reader 118, and one or more storage units 130, as well as the multilateration positioning unit 136 (which may also be included in the memory 128). The player input device 116 may include the value input device 114, to the extent that the player input device 116 is used to place wagers. In some embodiments, the value input device 114 can electronically receive wagering value (e.g., monetary value) from a player's casino account or other suitable "cashless gaming" value source. The I/O bus 122 may be coupled to an external system interface 124, perhaps comprising a network interface card and/or a wireless transceiver, which may in turn be connected to external systems 104 (e.g., wagering game networks) via a wired or wireless connection 144. In some embodiments, the external system interface 124 includes a transceiver 142. The transceiver 142 may be used to receive signals S1-S4 from which multilateration information 138 may be derived, as described herein.

In some embodiments, the wagering game machine 106 can include additional peripheral devices and/or more than one of each component shown in FIG. 1. For example, in some embodiments, the wagering game machine 106 can include several external system interfaces 124 and multiple CPUs 126. In some embodiments, any of the components can be integrated or subdivided. Additionally, in some embodiments, the components of the wagering game machine 106 can be interconnected according to any suitable interconnection architecture (e.g., directly connected, in series, in parallel, hypercube, etc.).

In some embodiments, any of the components of the wagering game machine 106 (e.g., the multilateration positioning unit 136) can include hardware, firmware, and/or software for performing the operations described herein. Furthermore, any of the components can include machine-readable media including instructions for causing a machine to perform the operations described herein. Machine-readable media includes any mechanism, such as the main memory 128 and the storage unit 130, that provides (i.e., stores and/or transmits) information in a form readable by a machine (e.g., a wagering game machine, computer, etc.). For example, in some embodiments, tangible machine-readable media may include read only memory (ROM), random access memory (RAM), magnetic disk storage media, optical storage media, flash memory machines, etc. Machine-readable media may also include any medium suitable for transmitting software over a network.

Thus, many embodiments may be realized. For example, a wagering apparatus 100 may comprise a wagering game machine 106 having a wagering game unit 132 operable to receive a wager in association with a wagering game. The wagering apparatus 100 may also comprise a multilateration positioning unit 136 operable to derive multilateration information 138 from a plurality of signals S1-S4 received from a plurality of transmission apparatus T1-T4 that can be used to determine a location L of the wagering game machine 106 in relation to the plurality of transmission apparatus T1-T4. The transmission apparatus T1-T4 may include physically separate transmitters, or multiple antennas coupled to one or more transmitters (e.g., one or more antennas connected to some number of transmitters, perhaps using duplexers or other types of signal splitters and/or multiplexers). Phase and time differences may be adjusted by adjusting the cable length between the transmission apparatus T1-T4 and the actual source of the signals S1-S4.

In some embodiments, the wagering apparatus 100 may include a memory 128 as a part of the wagering game machine 106, the memory 128 being configured to store multilateration information 138. Some embodiments of the wagering apparatus 100 may have a wired or wireless transceiver (e.g., as part of the external system interface 124) included in the wagering game machine 106, and/or a value input device 114 to electronically receive wagering value from a cashless gaming value source.

In some embodiments, the multilateration information 138 may include one or more reception time stamps, one or more reception time difference values, and/or one or more reception phase difference values, associated with the plurality of signals S1-S4. For example, the multilateration information 138 may include the time difference between signals S1 and S2, and the time difference between signals S2 and S3. This time difference information should be sufficient to locate the wagering game machine 106 at location L. Similarly, the multilateration information 138 may include the phase difference between signals S1 and S2, and the phase difference between signals S3 and S4. Many other combinations are possible.

In some embodiments, the apparatus 100 may include a location determination unit (LDU) 146 to determine the location L using the multilateration information 138. The location determination unit 146 may be coupled to the I/O bus 122, or included within the memory 128, or within the multilateration positioning unit 136, for example.

The apparatus 100 may include a transceiver 142 to receive the plurality of signals S1-S4. The transceiver 142 may comprise a transceiver included in the external system. interface 124, or a completely separate transceiver 142, perhaps coupled to the I/O bus 122 (or even directly to the CPU 126).

Many other embodiments may be realized. For example, a wagering apparatus 100 may comprise a wagering game machine 106 having a wagering game unit 132 operable to receive a wager in association with a wagering game, and a transmitter XMIT to transmit a signal to be received by a multilateration positioning unit 136 (e.g., a multilateration positioning unit physically separated from the apparatus 100) operable to derive multilateration information 138 from the signal S5 that can be used to determine a location of the wagering game machine in relation to a plurality of reception apparatus R1-R3. The reception apparatus R1-R3 may include a plurality of receivers to receive the signal S5 at substantially the same time, or a plurality of antennas to receive the signal S5 at substantially the same time. If multiple antennas are used, then one or more receivers may be coupled to more than one antenna, perhaps using a multiplexer (not shown). Propagation delay adjustment units PD1, PD2, and PD3 may be coupled to or included in the reception apparatus R1-R3. The Propagation delay adjustment units PD1, PD2, and PD3 may be used to adjust for fixed or variable propagation delays as selected by the designer of the machine 106, and perhaps as dictated by the environment in which the machine 106 is deployed. As noted previously, cables 162 coupled the reception apparatus R1-R3 may also have adjustable lengths to adjust reception signal delays to account for known propagation delays.

In some embodiments, the wagering game machine 106 may include one or more antennas 160, perhaps coupled to a transceiver 142 and/or the external system interface 124. The antennas 160 may in turn be coupled to one or more receivers RCV1, RCV2. The combination of antennas 160 and/or receivers RCV1, RCV2 may be used to assist in determining the orientation. of the apparatus 100. Thus, the antennas 160 may be coupled to separate receivers RCV1, RCV2, or to a single receiver RCV1, perhaps using a multiplexer (not shown), as is well known to those of skill in the art.

In some embodiments, for example, two receiving antennas 160 may be located on opposite sides of the wagering game machine 106, perhaps as far apart as is physically possible (e.g., about 10 cm to about 40 cm). If the wagering game machine 106 comprises a mobile device, and is pointing directly at one of the transmission apparatus T3 (or directly away from the transmission apparatus T3) then both receivers RCV1, RCV2 will receive the signal S3 from the transmission apparatus T3 at the same time. If the machine 106 is pointed at an angle of 90 degrees from the transmitter (e.g., receiving the signal S2 from the transmission apparatus T2) then a maximum time difference (or phase shift) may be obtained between the two receivers RCV1, RCV2. Receiving orientation information from at least two transmitters may permit calculating the true compass orientation of the machine 106. This feature may enable the display of "You Are Here" maps on displays 110, 112 of the machine, or be communicated to other machines in the surrounding environment (e.g., any of the machines 202 or the server 206 shown in FIG. 2, described below). Knowing the orientation of the machine 106 may enable display of a rotating map that is synchronized with a variety of physical objects in the surrounding environment.

Thus, in some embodiments, the wagering game machine 106 may include two or more antennas 160 to receive the plurality of signals S1-S4 and to assist in determining the orientation of the machine 106. In some embodiments, the wagering game machine 106 may include two or more receivers RCV1, RCV2 to receive the plurality of signals S1-S4 and to assist in determining the orientation of the machine 106.

Figure 2:
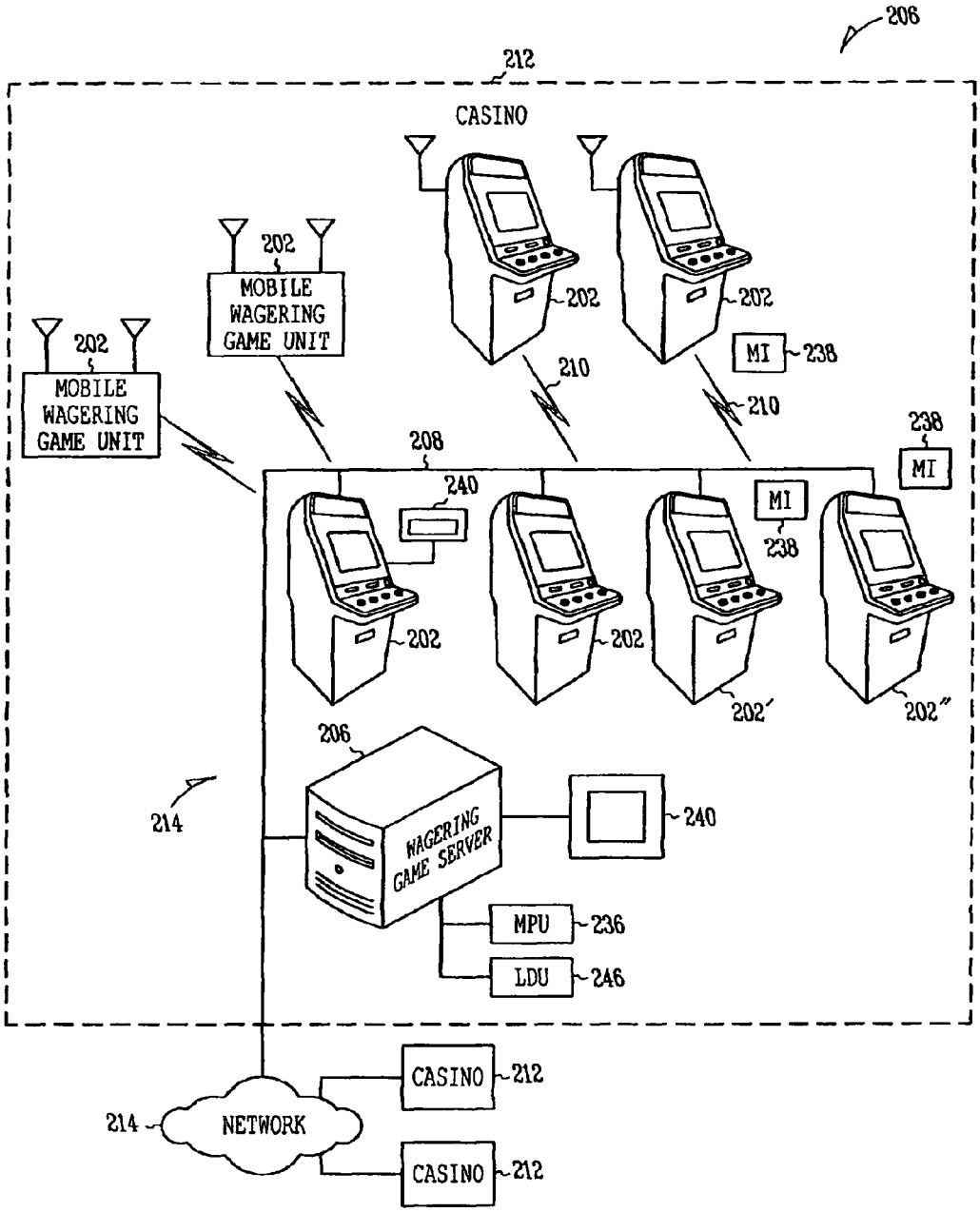
FIG. 2 is a block diagram illustrating a wagering game network, according to example embodiments of the invention.

While FIG. 1 describes example embodiments of a wagering game machine, FIG. 2 shows how a plurality of wagering game machines 202 can be connected in a wagering game network 200.

FIG. 2 is a block diagram illustrating a wagering game network 200, according to example embodiments of the invention. As shown in FIG. 2, the wagering game network 200 includes a plurality of casinos 212 connected to a communications network 214.

Each of the plurality of casinos 212 may include a local area network 214, which includes wagering game machines 202 coupled to a wagering game server 206 that may serve wagering games and multilateration information over the network 214. For example, multilateration information 238 with respect to a first wagering game machine 202' may be sent to a second wagering game machine 202". Similarly, multilateration information 238 with respect to the second wagering game machine 202" may be sent to the first wagering game machine 202'. The wagering game machines 202 and wagering game server 206 can include hardware and machine-readable media including instructions for multilateration positioning operations, as described herein. The wagering game server 206 may include, or be coupled to a multilateration positioning unit 236 and/or a location determination unit 246. Thus, in some embodiments, the wagering game server 206 can perform multilateration positioning operations in concert with serving wagering games over the local area network.

The wagering game machines 202 described herein can take any suitable form, such as floor standing models, handheld mobile units, bartop models, workstation-type console models, etc. Further, the wagering game machines 202 may be primarily dedicated for use in conducting wagering games, or may comprise a non-dedicated device, such as a mobile phone, personal digital assistant, personal computer, etc. The wagering game machines 202 may be similar to or identical to the wagering game machine 106 illustrated in FIG. 1. In some embodiments, the wagering game network 200 can include other network devices, such as accounting servers, wide area progressive servers, player tracking servers, and/or other devices suitable for use in connection with embodiments of the invention.

The components of each casino 212 can communicate over wired 208 and/or wireless connections 210. Furthermore, they can employ any suitable connection technology, such as Bluetooth, 802.11, Ethernet, public switched telephone networks, SONET, etc.

Referring now to FIGS. 1 and 2, it can be seen that additional embodiments may include a system 250 comprising one or more wagering apparatus 100, as described above with respect to FIG. 1, as well as a server 206 (e.g., a wide area progressive server) to transmit multilateration information 238 to the wagering game machines 202. The system 250 may also include a wired network 208 and/or a wireless network 210 to couple the server 206 to the wagering game machines 202.

In some embodiments, a system 250 may comprise one or more wagering game machines 106, 202 having a wagering game units 132 operable to receive a wager in association with a wagering game, a multilateration positioning unit 136 operable to derive multilateration information 138 from at least one transmitted signal S5, and a plurality of reception apparatus R1-R3 to receive the at least one transmitted signal S5 that can be used to determine a location L of the wagering game machine 106, 202 in relation to the plurality of reception apparatus R1-R3. The system 250 may include a transmitter XMIT to generate one or more transmitted signals S5, wherein the transmitter XMIT forms a portion of the wagering game machine 106, 202. The system 250 may also include a set of cables 162 to couple to the plurality of reception apparatus R1-R3, wherein the set of cables have a length that can be adjusted according to a propagation delay associated with one or more of the plurality of reception apparatus R1-R3. In the alternative, or in addition, the system 250 may include one or more propagation delay circuits PD1-PD3 (perhaps included in the reception apparatus R1-R3, respectively) to adjust a propagation delay associated with one or more of the reception apparatus R1-R3.

It should be understood that the apparatus and systems of various embodiments can be used in applications other than wagering game machines. Thus, various embodiments of the invention are not to be so limited. The illustrations of apparatus 100 and systems 250 are intended to provide a general understanding of the structure of various embodiments, and they are not intended to serve as a complete description of all the elements and features of apparatus and systems that might make use of the structures described herein.

Applications that may include the novel apparatus and systems of various embodiments include electronic circuitry used in high-speed computers, communication and signal processing circuitry, modems, single or multi-processor modules, single or multiple embedded processors, and application-specific modules, including multilayer, multi-chip modules. Such apparatus and systems may further be included as sub-components within a variety of electronic systems, such as data bridges, switches, and hubs; televisions and cellular telephones; personal computers and workstations; medical devices; radios and video players; and vehicles, among others.

Figure 3:
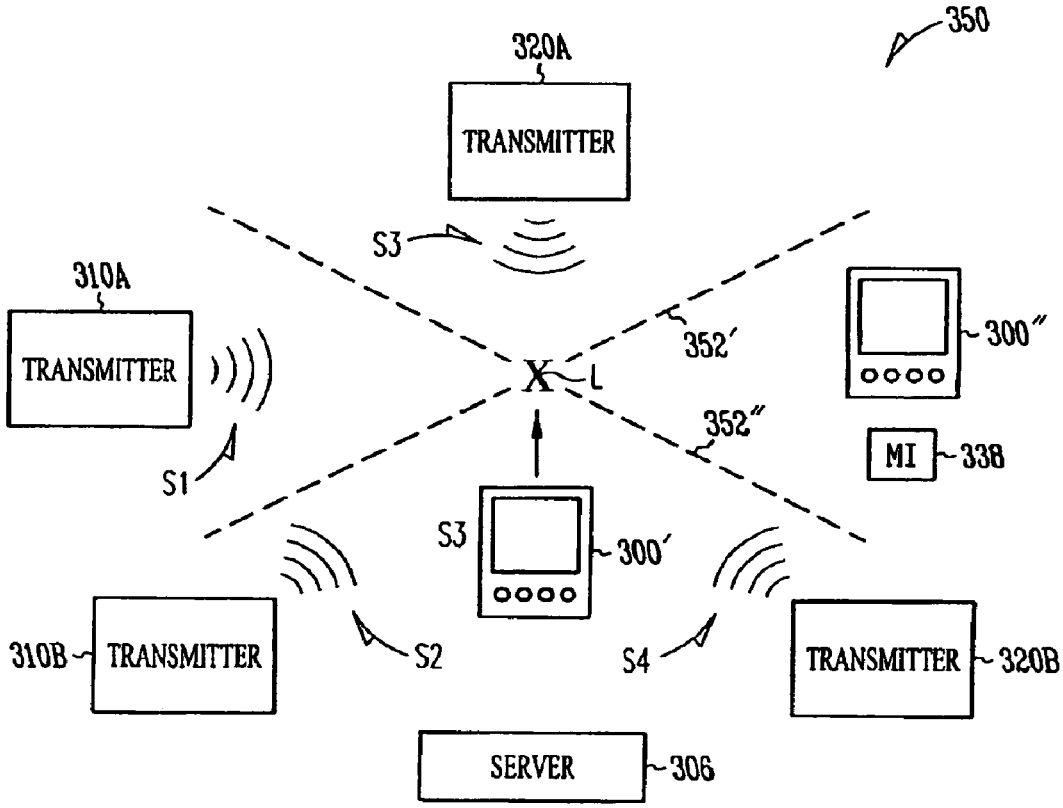
FIG. 3 is a schematic view of a system that uses multilateration position monitoring, according to example embodiments of the invention.

FIG. 3 is a schematic view of a system 350 that uses multilateration position monitoring, according to example embodiments of the invention. In some embodiments, the system 350 for multilateration position monitoring may comprise a system similar to or identical to the system 250. The system 350 may comprise a first pair of transmitters 310A, 310B and a second pair of transmitters 320A, 320B. In some embodiments, the transmitters 310A, 310B, 320A, 320B may be placed at substantially the same altitude (i.e., substantially coplanar), or at different altitudes. The location of the transmitters 310A, 310B, 320A, 320B may thus be fixed at known locations. A wagering game apparatus 300 (which can be similar to or identical to the apparatus 100 of FIG. 1) may operate to receive the signals S1-S4 from the transmitters 310A, 310B, 320A, 320B so as to determine its location L relative to the transmitters 310A, 310B, 320A, 320B. The signals S1-S4 may comprise radio frequency (RF) signals or light frequency signals (e.g., IR), among others.

In some embodiments, the wagering apparatus 300 may record time stamps for the arrival time of each of the two signals S1, S2 from the first transmitter pair 310A, 310B. Then the wagering apparatus 300 may record time stamps for the arrival time of each of the two signals S3, S4 from the second transmitter pair 320A, 320B. The wagering apparatus 300 may operate to calculate the time difference between pairs of signals (e.g., S1 and S2, or S1 and S3, or S1 and S4) and record the calculated time difference in lieu of, or in addition to the time stamps.

In some embodiments, the wagering apparatus 300 is capable of determining its own location. In other embodiments, the wagering apparatus 300' communicates multilateration information 338 (e.g., the time stamp or time difference information) to another device (e.g., another wagering apparatus 300" and/or a server 306), which then determines the location L of the wagering apparatus 300'. Using the differences between arrival times of a pair of signals, the location on the hyperbolic curves 352', 352"can be determined. This data can then be used to determine the location L where, in relation to the transmitters 310A, 310B, 320A, 320B, the wagering apparatus 300' is located. In another embodiment, a system 350 for multilateration positioning comprises three transmitters, which are grouped into two pairs (e.g., transmitter 310A is grouped with transmitter 310B as one pair, and transmitter 310A is alternately grouped with transmitters 320A to form another pair). Thus, a plurality of transmission apparatus (e.g., transmitters 310A, 310B, 320A, 320B) may include at least three transmission units operating as two alternating pairs.

Those of skill in the art will realize, after reading the information disclosed herein, that both transmission apparatus and/or reception apparatus may be substituted for the transmitters 310A, 310B, 320A, 320B, and that the wagering apparatus 300 may include receivers and/or transmitters, respectively, so that multilateration information 338 can be derived from the signals S1-S4 produced by the transmission apparatus, whether the transmission apparatus are located within or without the wagering apparatus 300.

Thus, referring now to FIGS. 2 and 3, it can be seen that numerous other embodiments may be realized. For example, a system 250, 350 may comprise a wagering game machine 202 or wagering apparatus 300 having a wagering game unit operable to receive a wager in association with a wagering game, and a multilateration positioning unit operable to derive multilateration information from a plurality of signals. The system 250, 350 may also include a plurality of transmission apparatus to transmit the plurality of signals that can be used to determine a location of the wagering game machine 202 or wagering apparatus 300 in relation to the plurality of transmission apparatus.

In some embodiments, the system 250, 350 may include a server 206, 306 to determine the location L of the wagering game machine 202 or wagering apparatus 300. Some systems 250, 350 may even include a display unit 240 (e.g., coupled to the server 206, 306) to display the location L. Of course, the location L may also be displayed locally, at a display 340 included in the wagering apparatus 300.

Any of the components previously described can be implemented in a number of ways, including simulation via software. Thus, the wagering apparatus 100, 300; wagering game machines 106, 202; payout mechanism 108; primary display 110; secondary display 112; value input device 114; player input device 116; information reader 118; I/O bus 122; external system interface 124; CPU 126; memory 128; storage unit 130; wagering game unit 132; multilateration positioning units 136, 236; multilateration information 138, 238, 338; transceiver 142; connection 144; location determination units 146, 246; antennas 160; cables 162; wagering game network 200; servers 206, 306; wired connections 208; wireless connections 210; casinos 212; network 214; display unit 240; systems 250, 350; transmitters 310A, 310B, 320A, 320B; display 340; hyperbolic curves 352; location L; propagation delay adjustment units PD1-PD3; reception apparatus R1-R3; signals S1-S5; transmission apparatus T1-T4; and transmitter XMIT may all be implemented as "modules" herein.

These modules may include hardware circuitry, single or multi-processor circuits, memory circuits, software program modules and objects, firmware, and combinations thereof, as desired by the architect of the apparatus 100, 300 and systems 250, 350, and as appropriate for particular implementations of various embodiments. In some embodiments, the modules may be included in a system operation simulation package such as a software electrical signal simulation package, a power usage and distribution simulation package, a network security simulation package, a power/heat dissipation simulation package, a signal transmission-reception simulation package, or any combination of software and hardware used to simulate the operation of various potential embodiments. Such simulations may be used to characterize or test the embodiments, for example.

Example Operations

Figure 4:
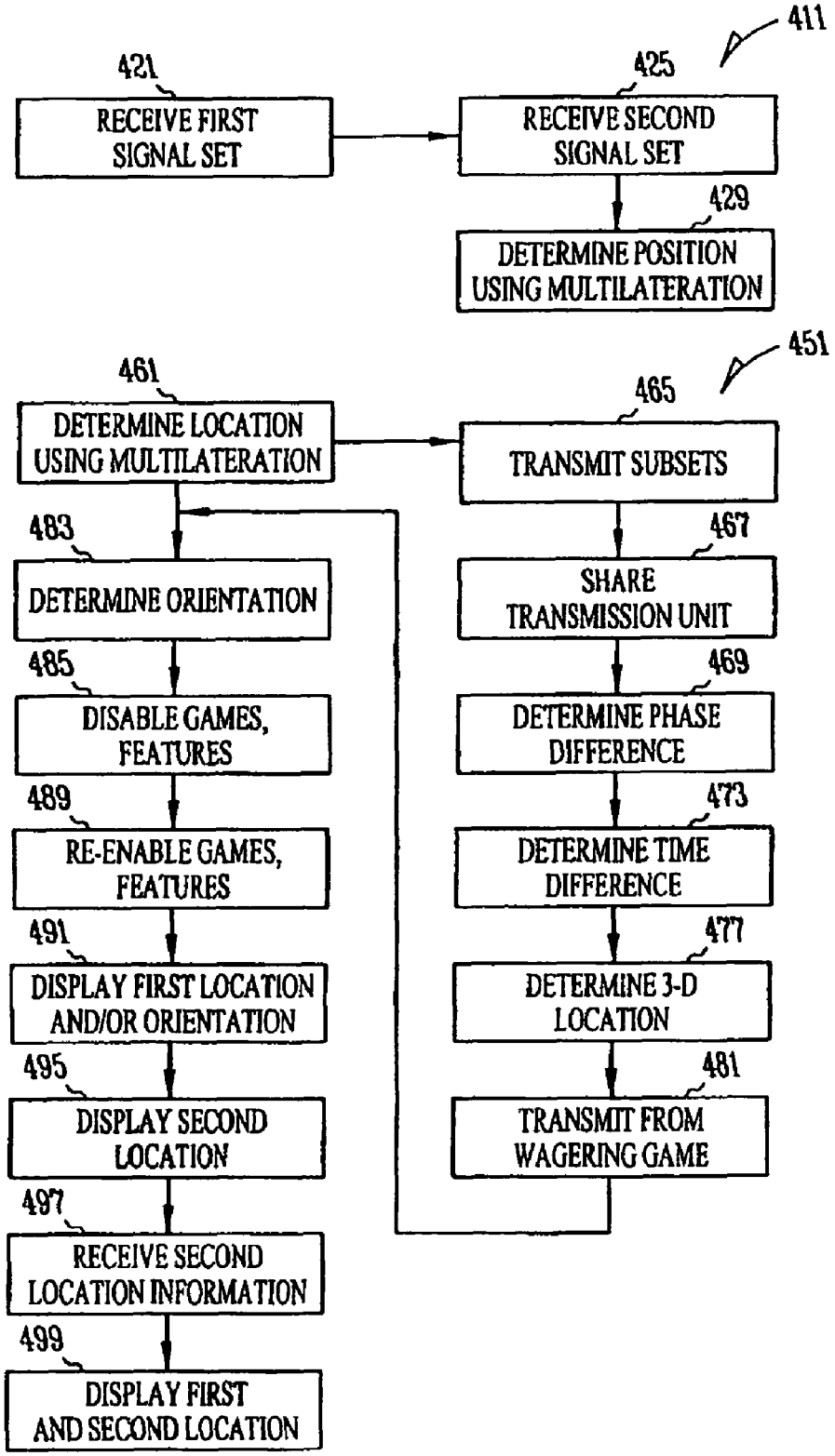
FIG. 4 is a flowchart illustrating various methods of multilateration position monitoring, according to example embodiments of the invention.

FIG. 4 is a flowchart illustrating various methods 411, 451 of multilateration position monitoring, according to example embodiments of the invention.

At block 421, a first set of signals may be received and the time of receipt may be recorded. At block 425, a second set of signals may be received and the time of receipt may be recorded. At block 429, the time differences between arrival times of the pairs of signals may be used to determine the receiver's (e.g., apparatus 100, or wagering game machine 106) location.

In some embodiments, an additional transmitter at an altitude different than the other transmitters (e.g., not located in the same plane as the other transmitters) may be used to transmit signals that enable the determination of the receiving device's altitude (e.g., in the z-plane). The altitude information can be used along with a planar position to obtain the three-dimensional location of the receiving device (or transmitting device, if receivers are used to locate a device having a transmitter).

Thus, in some embodiments, a device, such as a wagering game machine 106, includes a transmitter to broadcast a signal. Multiple fixed position antennas (coupled at one or more receivers) may be used as reception apparatus. The fixed reception apparatus may be used to determine the reception time of the signal sent by the transmitting device. From the reception time at each instance of the reception apparatus, differences in reception time can be calculated and used to establish hyperbolic LOPs. This data can then be used to determine where, in relation to the reception apparatus, the transmitting device (e.g., the apparatus 100, or wagering game machine 106) is located.

Thus, many embodiments may be realized. For example, some embodiments may include (e.g., in a wagering game machine operable to receive a wager associated with a wagering game) a method 451 that comprises determining the location of a wagering game machine in relation to origination points of a plurality of signals (e.g., multiple transmission apparatus), or in relation to multiple reception apparatus, by a multilateration process at block 461. Determining the location may include, at block 465, transmitting a first subset of the plurality of signals to the wagering game machine using a first pair of transmission apparatus, and transmitting a second subset of the plurality of signals to the wagering game machine using a second pair of transmission apparatus. The method 451 may include sharing a single transmission unit between the first pair of transmission apparatus and the second pair of transmission apparatus, as described above, at block 467.

Determining the location at block 461 may include, at block 469, determining a phase difference between some of the plurality of signals. Determining the location at block 461 may include, at block 473, determining a time difference between some of the plurality of signals. Determining the location at block 461 may include, at block 477, determining the location of the wagering apparatus in three-dimensional space. In some embodiments, determining the location may include, at block 481, transmitting a signal from the wagering game machine to a plurality of reception apparatus, wherein multilateration information can be derived from the plurality of signals. In some embodiments, the method 451 may include determining an orientation of the wagering game machine at block 483.

As mentioned previously, in some embodiments, the method 451 may include disabling one or more games, and/or one or more game features based on the determined location of a wagering game device at block 485. Similarly, the method 451 may include re-enabling games, and/or game features based on the determined location at block 489.

In some embodiments, the method 451 may include displaying a first location (and/or orientation) associated with a first wagering game machine on a display included in the first wagering game machine at block 491, or at some other selected display, such as at a display coupled to a gaming server. In some embodiments, a second location associated with a second wagering game machine may be determined at block 495 using a multilateration process, or in other ways, such as by using triangulation, or by using a global positioning system. The method 451 may then include receiving information including the second location at block 497, and perhaps, displaying the first location and the second location on a display included in the first wagering game machine, or the second wagering game machine, or both, at block 499.

The methods described herein do not have to be executed in the order described, or in any particular order. Moreover, various activities described with respect to the methods identified herein can be executed in repetitive, serial, or parallel fashion. Information, including parameters, commands, operands, and other data, can be sent and received in the form of one or more carrier waves.

One of ordinary skill in the art will understand the manner in which a software program can be launched from a computer-readable medium in a computer-based system to execute the functions defined in the software program. Various programming languages may be employed to create one or more software programs designed to implement and perform the methods disclosed herein. The programs may be structured in an object-orientated format using an object-oriented language such as Java or C++. Alternatively, the programs can be structured in a procedure-orientated format using a procedural language, such as assembly or C. The software components may communicate using a number of mechanisms well known to those skilled in the art, such as application program interfaces or interprocess communication techniques, including remote procedure calls. The teachings of various embodiments are not limited to any particular programming language or environment.

Thus, other embodiments may be realized, including a machine-readable medium encoded with instructions for directing a machine to perform operations comprising any of the methods described herein. For example, some embodiments may include a machine-readable medium encoded with instructions for directing a wagering game machine operable to receive a wager to perform a variety of operations. Such operations may include locating a first wagering game machine, operable to receive a wager associated with a wagering game, at a first location by a multilateration process.

Additional operations may include displaying the first location on a display included in the first wagering game machine, receiving information including a second location associated with a second wagering game machine, and displaying the first location and the second location on a display included in the first wagering game machine, the second wagering game machine, or both. Other operations may include any of the activities presented in conjunction with the methods described above.

Example Wagering Game Machine

Figure 5:
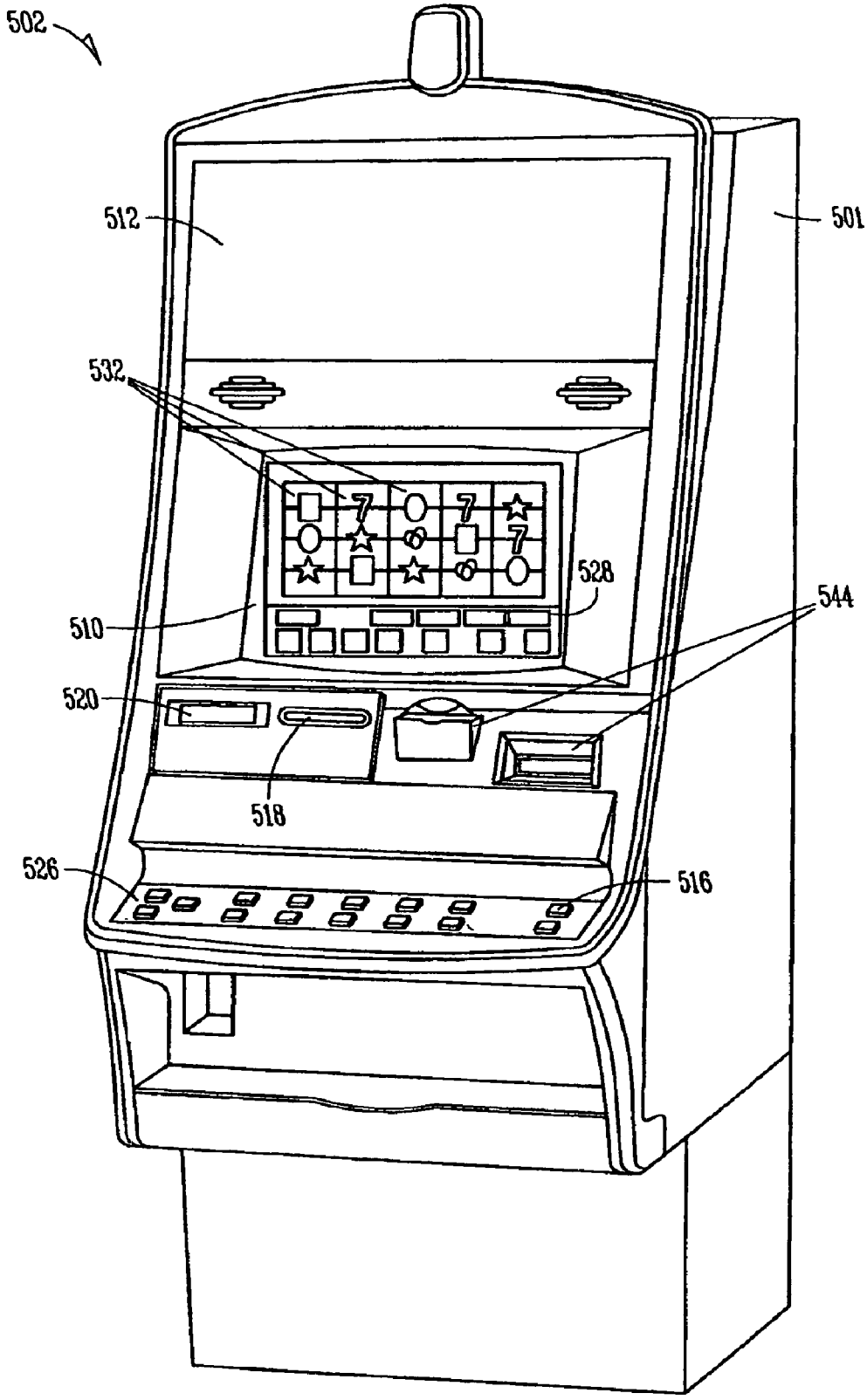
FIG. 5 is a perspective view of a wagering game machine, according to example embodiments of the invention.

FIG. 5 is a perspective view of a wagering game machine 502, according to example embodiments of the invention. Referring to FIG. 5, the wagering game machine 502 (which may be similar to or identical to the machines 106, 202, and included in a wagering apparatus 100, 300, described above) may be used in gaming establishments, such as casinos. According to some embodiments, the wagering game machine 502 can be any type of wagering game machine and can have varying structures and methods of operation. For example, the wagering game machine 502 may comprise an electromechanical wagering game machine configured to play mechanical slots, or it may comprise an electronic wagering game machine configured to play video casino games, such as blackjack, slots, keno, poker, blackjack, roulette, etc.

The wagering game machine 502 may comprise a housing 501 and include input devices, such as wager input devices 544 (perhaps coupled to a value input device 114, shown in FIG. 1), and a player input device 516. For output, the wagering game machine 502 may include a primary display 510 for displaying information about a basic wagering game. The primary display 510 can also display information about a bonus wagering game, a progressive wagering game, game machine 502 location information (as well as location information for other game machines), and one or more attract packages. The wagering game machine 502 may also include a secondary display 512 for displaying wagering game events, wagering game outcomes, attract packages, and/or signage information. While some components of the wagering game machine 502 are described herein, numerous other elements can exist and can be used in any number or combination to create varying forms of the wagering game machine 502.

The wager input devices 544 can take any suitable form and may be located on the front of the housing 501. The wager input devices 544 can receive currency and/or credits inserted by a player. The wager input devices 544 can include coin acceptors for receiving coin currency and bill acceptors for receiving paper currency. Additionally, the wager input devices 544 can include ticket readers or barcode scanners for reading information stored on vouchers, cards, or other tangible portable storage devices. The vouchers or cards may authorize access to central accounts, which can transfer money to the wagering game machine 502. Some wagering game machines 502 may utilize RFID technology to passively identify players and accept payment using an RFID device carried by a player without the player having to carry out specific actions or enter anything physical into the game.

The player input device 516 may comprise a plurality of push buttons on a button panel 526 for operating the wagering game machine 502. In addition, or alternatively, the player input device 516 can comprise a touch screen 528 mounted over the primary display 510 and/or secondary display 512.

The various components of the wagering game machine 502 can be connected directly to, or contained within, the housing 501. Alternatively, some of the wagering game machine's components can be located outside of the housing 501, while being communicatively coupled with the wagering game machine 502 using any suitable wired or wireless communication technology.

The operation of the basic wagering game can be displayed to the player on the primary display 510. The primary display 510 can also display a bonus game associated with the basic wagering game. The primary display 510 may include a cathode ray tube (CRT), a high resolution liquid crystal display (LCD), a plasma display, light emitting diodes (LEDs), or any other type of display suitable for use in the wagering game machine 502. Alternatively, the primary display 510 can include a number of mechanical reels to display the outcome. In FIG. 5, the wagering game machine 502 is shown as an "upright" version in which the primary display 510 is oriented vertically relative to the player. Alternatively, the wagering game machine can be a "slant-top" version in which the primary display 510 is slanted at about a thirty-degree angle toward the player of the wagering game machine 502. In yet another embodiment, the wagering game machine 502 can be a bartop model, a handheld mobile unit, a gaming device in a server-based system, or a workstation-type console model, among others.

A player may begin playing a basic wagering game by placing a wager via the player input device 516 and/or the wager input device 518. The player can initiate play by using the push buttons or the touch screen 528 or the player input device 516. The basic game can include arranging a plurality of symbols along a payline 532, which indicates one or more outcomes of the basic game. Such outcomes can be randomly selected in response to player input. At least one of the outcomes, which can include any variation or combination of symbols, can trigger the occurrence of a bonus game.

In some embodiments, the wagering game machine 502 can also include an information reader 520, which can include a card reader, ticket reader, bar code scanner, RFID transceiver, or computer readable storage medium interface. In some embodiments, the information reader 520 can be used to award complimentary services, restore game assets, track player habits, etc.

Implementing the apparatus, systems, and methods disclosed herein may operate to permit the use of multilateration to locate wagering gaming machines, perhaps providing an enhanced gaming experience for players, and/or increased security for machine owners.

General Comments

In the following detailed description, reference is made to specific examples by way of drawings and illustrations. These examples are described in sufficient detail to enable those skilled in the art to practice the inventive subject matter, and serve to illustrate how the inventive subject matter may be applied to various purposes or embodiments. Other embodiments are included within the inventive subject matter, as logical, mechanical, electrical, and other changes may be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments.

Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted to require more features than are expressly recited in each claim. Rather, inventive subject matter may be found in less than all features of a single disclosed embodiment. Thus the following claims are hereby incorporated into the Detailed Description, with each claim standing on its own as a separate embodiment.

What is claimed is:

1. A gaming system implemented by a gaming establishment having a restricted gaming area in which wagering games are not permitted, and a non-restricted gaming area in which wagering games are permitted, the gaming system comprising:

at least one game machine configured to receive a wager from a player to initiate a wagering game;

a multilateration positioning system configured to transmit and receive one or more locator signals, the multilateration positioning system comprising:

at least one game locator mounted to the at least one game machine;

at least three fixed locators mounted at fixed positions spaced apart from each other;

one or more processors; and at least one memory device including instructions that, when executed by the multilateration positioning system, cause the multilateration positioning system to:

receive one or more locator signals, wherein each of the one or more received locator signals is transmitted by one of the locators at a transmittal time and received by one or more other locators at one or more arrival times;

measure time differences of arrival between the arrival times of the one or more received locator signals;

based on the measured time differences, determine an intersection of at least two hyperbolic lines of position associated with the at least three fixed locators, wherein the intersection identifies a location of the at least one game machine with respect to the restricted and non-restricted gaming areas; and wherein, in response to the at least one game machine being located in the restricted gaming area, the gaming system disables the at least one game machine such that the at least one game machine cannot conduct the wagering game while in the restricted gaming area.

2. The gaming system of claim 1, wherein the gaming system disables the at least one game machine by disabling one or more game features of the wagering game.

3. The gaming system of claim 1, wherein each of the one or more locator signals has a different frequency.

4. The gaming system of claim 1, wherein at least one time difference of arrival is measured by subtracting the arrival time of one received locator signal from the arrival time of another received locator signal.

5. The gaming system of claim 1, wherein at least one time difference of arrive is measured by subtracting the arrival time of one received locator signal at one locator from the arrival time of the one received locator signal at another locator.

6. The gaming system of claim 1, wherein at least one of the time differences is derived by measuring a phase difference between the one or more received locator signals.

7. The gaming system of claim 1, wherein the one or more locator signals including a first locator signal transmitted at a first transmittal time and received at a first arrival time, and a second locator signal transmitted at a second transmittal time and received at a second arrival time, and wherein the first and second transmittal times are separated by a selectable delay period and the selectable delay period is subtracted from the time difference of arrival between the first arrival time and the second arrival time.

8. A gaming system configured to locate and control a handheld wagering game machine in a gaming establishment, the gaming establishment having a restricted gaming area in which wagering games are not permitted, and a non-restricted gaming area in which wagering game are permitted, the gaming system comprising:

a wagering game server configured to provide, via a communications network, one or more games including at least one wagering game to one or more wagering game machines for game play by a player, the one or more wagering game machines including the handheld game machine, the handheld game machine being configured to receive a wager from the player to initiate the at least one wagering game;

a multilateration positioning system configured to transmit and receive one or more locator signals, the multilateration positioning system comprising:

at least one game locator mounted to the handheld game machine;

at least three fixed locators mounted at fixed positions spaced apart from each other;

one or more processors; and at least one memory device including instructions that, when executed by the one or more processors, cause the multilateration positioning system to:

receive one or more locator signals, wherein each of the one or more received locator signals is transmitted by one of the locators at a transmittal time and received by one or more other locators at one or more arrival times;

measure time differences of arrival between the arrival times of the one or more received locator signals;

based on the measured time differences, determine an intersection of at least two hyperbolic lines of position associated with the at least three fixed locators, wherein the intersection identifies a location of the handheld game machine with respect the restricted gaming area and the non-restricted gaming area; and wherein, in response to the handheld game machine being located in the restricted gaming area, the gaming system disables the handheld game machine such that the handheld game machine cannot conduct the at least one wagering game while in the restricted gaming area.

9. The gaming system of claim 8, further comprising, in response to the handheld game machine being located in the non-restricted gaming area, the gaming system enables the at least one handheld game machine to conduct the at least one wagering game.

10. The gaming system of claim 8, wherein the gaming system disables the at least one game machine by disabling one or more game features of the at least one wagering game.

11. The gaming system of claim 8, therein the gaming system disables the at least one game machine by ceasing to provide the at least one wagering game to the at least one game machine.

12. The gaming system of claim 8, wherein the at least one game locator is a signal receiver and the at least three fixed locators are signal transmitters.

13. The gaming system of claim 8, wherein the game locator receives the locator signals via at least two spaced-apart antennas mounted to the handheld game machine, and a time difference of arrival between the arrival times of a locator signal received by the at least two antennas is measured to determine an angular position of the handheld game machine.

14. A method of locating at least one game machine within a gaming establishment utilizing a multilateration positioning system configured to transmit and receive one or more locator signals, the multilateration positioning system including at least one game locator mounted to the at least one game machine and at least three fixed locators mounted at fixed positions spaced apart from each other, the at least one game machine configured to receive a wager from a player to initiate a wagering game, the method comprising:

receiving one or more locator signals, each of the one or more received locator signals being transmitted by one of the locators at a transmittal time and being received by one or more other locators at one or more arrival times;

measuring, via one or more processors, time differences of arrival between the arrival times of the one or more received locator signals;

based on the measured time differences, determining, via the one or more processors, an intersection of at least two hyperbolic lines of position associated with the at least three fixed locators, wherein the intersection corresponds to a location of the at least one game machine with respect to a restricted gaming area in which wagering games are not permitted and a non-restricted gaming area in which wagering game are permitted; and in response to the at least one game machine being located in the restricted gaming area, disabling the at least one game machine such that the at least one game machine cannot conduct the wagering game while in the restricted gaming area.

15. The method of claim 14, wherein the gaming system disables the at least one game machine by disabling one or more game features of the wagering game.

16. The method of claim 14, wherein at least one time difference of arrival is measured by subtracting the arrival time of one received locator signal from the arrival time of another received locator signal.

17. The method of claim 14, wherein at least one time difference of arrival is measured by subtracting the arrival time of one received locator signal at a locator from the arrival time of the one received locator signal at another locator.

18. The method of claim 14, wherein at least one of the time differences is derived by measuring a phase difference between the one or more received locator signals.

19. The method of claim 14, wherein the at least one game locator is a signal transmitter and the at least three fixed locators are signal receivers.

20. The method of claim 14, wherein the at least one game locator is a signal receiver and the at least three fixed locators are signal transmitters.

21. The method of claim 14, wherein the one or more locator signals including a first locator signal transmitted at a first transmittal time and received at a first arrival time, and a second locator signal transmitted at a second transmittal time and received at a second arrival time, and wherein the first and second transmittal times are separated by a selectable delay period and the selectable delay period is subtracted from the time difference of arrival between the first arrival time and the second arrival time.

22. A machine-readable, non-transitory medium implemented by a gaming system in a gaming establishment, the gaming system including one or more handheld game machines and a multilateration positioning system configured to transmit and receive one or more locator signals, the multilateration positioning system including at least one game locator mounted to each of the one or more handheld game machines and at least three fixed locators mounted at fixed positions spaced apart from each other, the one or more handheld game machines being configured to receive a wager from a player to initiate a wagering game, the medium including executable instructions that, when executed by the gaming system, cause the gaming system to perform a method comprising:

receiving one or more locator signals, wherein each of the one or more received locator signals is transmitted by one of the locators at a transmittal time and received by one or more other locators at one or more arrival times;

measuring time differences of arrival between the arrival times of the one or more received locator signals;

based on the measured time differences, determining, for each of the one or more handheld game machines, an intersection of at least two hyperbolic lines of position associated with the at least three fixed locators, wherein each intersection identifies a location of each of the one or more handheld game machines with respect to a restricted gaming area of the gaming establishment and a non-restricted gaming area of the gaming establishment; and in response to any one of the one or more handheld game machines being located in the restricted gaming area, disabling the any one of the one or more handheld game machines such that the any one of the one or more handheld game machines cannot conduct a wagering game while in the restricted gaming area.

23. The machine-readable medium of claim 22, wherein the any one of the one or more handheld game machines are disabled by disabling one or more game features of the wagering game.

* * * * *

UNITED STATES PATENT AND TRADEMARK OFFICE

CERTIFICATE OF CORRECTION

PATENT NO. : 8,162,750 B2
APPLICATION NO. : 12/281893
DATED : April 24, 2012
INVENTOR(S) : Gagner et al.

It is certified that error appears in the above-identified patent and that said Letters Patent is hereby corrected as shown below:

In column 4, line 52, Delete “system.” and insert --system--, therefor

In column 5, line 20, Delete “orientation.” and insert --orientation--, therefor In column 7, line 54, Delete “352"can” and insert --352" can--, therefor Signed and Sealed this
Twenty-eighth Day of August, 2012

David J. Kappos

David J. Kappos
*Director of the United States Patent and Trademark Office*